United States Patent [19]

Ooka et al.

[11] Patent Number: 4,794,655

[45] Date of Patent: Jan. 3, 1989

[54] TRUCK TYPE PATIENT-MOVING DEVICE

[75] Inventors: Akihiro Ooka, Suita; Kenji Okamoto, Kobe; Koji Yamada, Suita, all of Japan

[73] Assignees: Agency of Industrial Science & Technology; Ministry of International Trade & Industry, both of Tokyo, Japan

[21] Appl. No.: 31,668

[22] Filed: Mar. 30, 1987

[30] Foreign Application Priority Data

Apr. 25, 1986 [JP] Japan ..... 61-94642
Jun. 19, 1986 [JP] Japan ..... 61-141309
Aug. 1, 1986 [JP] Japan ..... 61-179863

[51] Int. Cl.[4] ..... A61G 7/08
[52] U.S. Cl. ..... 5/81 R; 5/81 B
[58] Field of Search ..... 5/81 R, 81 B, 81 C, 5/61

[56] References Cited

U.S. PATENT DOCUMENTS 3,493,979 2/1970 Koll et al. ..... 5/81 C
3,765,037 10/1973 Dunkin ..... 5/81 C
3,854,152 12/1974 Chez ..... 5/81 C
3,947,902 4/1975 Conde et al. ..... 5/81 R
3,967,328 7/1976 Cox ..... 5/81 R
4,073,016 2/1978 Koll ..... 5/81 R
4,077,073 3/1978 Koll et al. ..... 5/81 R
4,669,137 6/1987 Schnelle et al. ..... 5/81 R
4,680,818 7/1987 Ooka et al. ..... 5/81 R

*Primary Examiner*—Alexander Grosz
*Attorney, Agent, or Firm*—Oblon, Fisher, Spivak, McClelland & Maier

[57] ABSTRACT

A patient moving device includes a movable support means, a loading-unloading means disposed on the support means for loading and unloading a patient and provided with a horizontal base plate held on the support means and an insertion plate inserted under a patient and adapted to move in and out of the horizontal plate, and a means for holding the horizontal base plate on the support means so as to be capable of being advanced and retracted in the same direction as the insertion plate.

7 Claims, 9 Drawing Sheets

TRUCK TYPE PATIENT-MOVING DEVICE

BACKGROUND OF THE INVENTION

1. Field of the Invention

This invention relates to a patient-moving device whereby it is possible to move a bedridden person (hereinafter referred to as a "patient") from the bed without applying burdens on the patient or without relying on an attendant for assistance, and more particularly to such a moving device which is configured so as to be movable.

2. Description of the Prior Art

There are persons who because of bodily infirmities require assistance in their daily activities such as eating meals, bathing, moving their bowels, or undergoing therapy.

Devices for moving such persons from the bed bed without applying burdens on the patient or without relying on an attendant for assistance have already been proposed in U.S. Pat. Nos. 3,947,902, 4,680,818, and Japanese Patent Public Disclosure SHO No. 61(1986)-135656. These devices consist of a horizontal base plate resting on a means of locomotion such as a truck, and a loading-unloading device which is located on this horizontal base plate and which contains an insertion plate which can be moved out from and into the horizontal base plate. From a position at the side of the bed where the patient is lying, the insertion plate is first inserted between the bed and the patient. Then the insertion plate, with the patient resting thereon, is moved onto the aforesaid base plate, thus moving the patient onto the means of locomotion. The opposite procedure is carried out in order to move the patient from the insertion plate onto the bed.

Such loading-unloading devices, by utilizing driving means such as motors for driving the insertion plate in and out, contributes not only to alleviating the burden on the attendant, but also to automating the work.

These loading-unloading devices can move the patient from the bed onto the insertion plate or from the insertion plate onto the bed, but no particular considerations were incorporated concerning the patient's position on the bed during loading.

That is, since there is limited space between the sides of beds positioned in rows in hospitals or other institutions where these patient-moving devices are to be used, this fact imposes intrinsic limitations also on the widths of the moving devices. In actual fact, an adult's hospital bed is usually around one meter in width, and the moving devices must be made quite narrow in width, around 50–60 cm.

On the other hand, the patient is not always lying in the center of the bed or on the side accessible to the moving device. Therefore, when the insertion plate cannot reach the patient on the bed even when the insertion plate has been extended all the way out from the loading-unloading device, it will still be necessary for the attendant to pick up the patient and to move him or her within the range on the bed where the insertion plate can reach.

The series of operations whereby the insertion plate is extended and inserted between the patient and the bed, and after the patient has been placed on the extended insertion plate, the plate is retracted and brought back onto the horizontal base plate, is performed by driving means such as motors. In this case, the load on the driving means will differ greatly when the patient is not on the insertion plate an after the patient is placed on the insertion plate and the patient's weight is applied onto the plate. In the aforesaid loading-unloading devices of the past, no consideraton at all was given to these changes in the loads applied to the driving means. Therefore, they had certain drawbacks, such as the fact that excessive strains were applied on the driving means and the fact that the devices were complicated to operate.

Furthermore, patients loaded onto the insertion plate in a recumbent position must sometimes be put into a seated position or returned from the seated position to the recumbent position on the insertion plate. Since the insertion plates in the aforesaid loading-unloading devices of the past are as long as a patient's height, assistance of an attendant is necessary in order to change the patient's position in this way, and, when the patient is in a seated position, an attendant must support the patient at all times in order to maintain this position. Moreover, since the insertion plates are as long as a patient's height, large loads are also applied to the driving devices of the insertion plates, and this is not desirable.

In this way, the moving devices of the past still have various problems requiring improvement and cannot be said to be perfect, even though they are able to lessen the burden on the attendants to some degree.

OBJECTS OF THE INVENTION

The first object of this invention is to provide a moving device whereby moving operations can be performed easily, without applying any burden at all on the attendant, regardless of what position on the bed the patient may be in.

Another object of the invention, in addition to the aforesaid first object, is to provide a moving device whereby the driving means may be controlled and the insertion plate moved in and out smoothly when the patient is laid on the insertion plate and the patient's weight is applied as a load onto the driving means.

Still another object of the invention is to provide a moving device whereby the patient's position can be changed from the recumbent to the seated position and from the seated to the recumbent position without applying excessive force on the patient's body and without any assistance by an attendant.

SUMMARY OF THE INVENTION

In order to achieve the aforesaid purposes, the moving device according to this invention is equipped with a movable support means and a loading-unloading means which is located on the support means and which can load or unload the patient to or from the bed. The aforesaid loading-unloading means consists of a horizontal base plate supported on the aforesaid support means and an insertion plate which can be moved into and out of said horizontal base plate and which can be inserted under the patient. The aforesaid support means is equipped with a means for holding the horizontal base plate of the aforesaid loading-unloading means so that it can be moved in and out in the same direction as the aforesaid insertion plate, and with a driving means for moving the aforesaid horizontal base plate in and out.

The insertion plate of the aforesaid loading-unloading means is formed integrally of an upper plate and a lower plate which are stacked over each other with a gap between them. It can be moved in and out of the aforesaid base plate freely. Moreover, the aforesaid loading-unloading means is equipped with a lower belt which is wound around the aforesaid lower plate, forming a closed loop, and in some places is fastened to the front parts of the aforesaid base plate; an upper belt which passes above and below the aforesaid upper plate from the front end of the upper plate and is brought to its rear; upper rollers which are located at a fixed position with respect to the aforesaid base plate so that they will be located at the rear of the aforesaid insertion plate and which wind the end side of the aforesaid upper belt as it passes above the aforesaid upper plate; lower rollers which are located at fixed positions with respect to the aforesaid base plate so that they will be located at the rear of the aforesaid insertion plate and which wind the end side of the aforesaid upper belt as it passes between the aforesaid upper plate and lower plate; devices installed on both the aforesaid upper and lower rollers for sending out the aforesaid upper belt when it is wound up or for winding it in; and a driving device for the aforesaid insertion plate which is located on both sides of the insertion plate and which moves the insertion plate in and out of the aforesaid base plate. The loading-unloading means is configured so that, during insertion, it will move the aforesaid insertion, plate in and out and will move out the aforesaid upper belt from the aforesaid lower rollers, while keeping the aforesaid upper rollers in a state where they cannot turn; and, during retraction of the insertion plate it will wind in the aforesaid upper belt by means of the aforesaid upper and lower rollers while retracting the upper belt together with the aforesaid insertion plate.

In a patient-moving device configured as described above, during loading of the patient, the base plate is also moved out towards the patient while the insertion plate is moved out. This makes it possible to load a patient who is farther away.

Other purposes and other characteristics of this invention are made clear in the following detailed explanations based on the attached drawings.

DETAILED DESCRIPTION OF THE PREFERRED EMBODIMENTS

Figure 1:
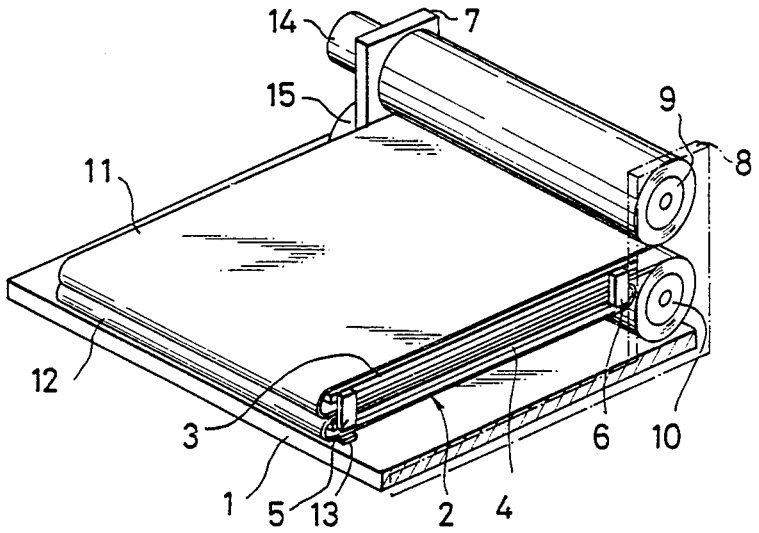
FIG. 1 is a schematic perspective view illustrating an example of a patient loading-unloading device which can be applied in the patient-moving device of this invention.

Referring first to FIG. 1, an embodiment of the patient loading-unloading device in a moving device to which this invention is applicable will be explained.

That is, the loading-unloading device illustrated in FIG. 1 has a horizontal base plate 1, and an insertion plate 2 which can be freely moved in and out in the horizontal direction is rested on the base plate 1. The insertion plate 2 consists of an upper plate 3 and a lower plate 4 which are stacked in parallel over each other with a gap between them. The insertion plate 2 is formed integrally by spacers 5, 6 positioned at its front, back, left and right corners.

A pair of posts 7 and 8 are also located on both sides at the back of the horizontal base plate 1. A pair of upper and lower rollers 9 and 10 are supported on the posts 7, 8 so that they can turn and be locked freely. An upper belt 11, which has one of its ends wrapped on the upper roller 9, passes over the upper plate 3. It moves around the front end of the upper plate 3 and passes through between the upper plate 3 and the lower plate 4, and its other end is wound onto the lower roller 10.

On the other hand, a lower belt 12 is brought down from the top surface of the lower plate 4 around both of its ends so as to form a closed loop around the lower plate and is fastened to a fastening part 13 near the front of the horizontal base plate 1.

On one post 7 are installed reversible motors 14 and 15 with lock-control mechanisms which are for driving the upper and lower rollers 9 and 10 respectively, so that each can be rotated or locked independently.

Figure 2:
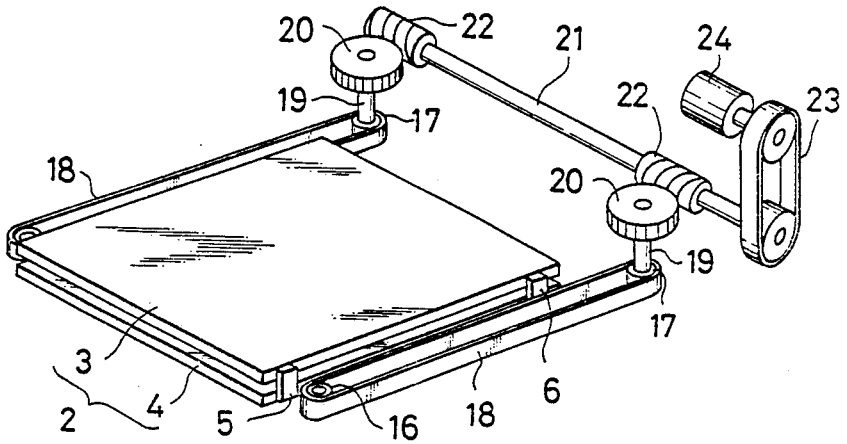
FIG. 2 is a schematic perspective view illustrating an example of the driving mechanism of the insertion plate of the loading-unloading device in FIG. 1.

As is shown in FIG. 2, on both sides of the horizontal base plate 1 are positioned two pairs of pulleys 16 and 17 which are positioned at the front and back along the side of the insertion plate 2 and are configured so that they will rotate around vertical fixed shafts 19. An endless belt 18 is mounted on each of these pairs of pulleys, and one part of the endless belt 18 is fastened onto the aforesaid insertion plate 2—that is, onto the sides of the upper and lower plates 3 and 4.

Worm wheels 20 are fastened to the top of the shafts 19 of the rear pulleys 17. The worm wheels 20 mesh with worm gears 22 which are fixed to a transmission shaft 21, both ends of which are supported on posts 7 and 8. The pair of worm gears 22 are in an inverse gear relationship and are configured so that the worm wheels 20 will rotate at the same speed in the opposite directions when the transmission shaft 21 turns. Moreover, the transmission shaft 21 is driven through a transmission belt 23 by a reversible motor 24. These elements comprise the driving mechanism for moving the insertion plate 2 in and out.

As one can understand from a comprison of FIGS. 1 and 2, the insertion plate driving device, which is shown in FIG. 2, is omitted in FIG. 1. On the other hand, the belts 11 and 12 in FIG. 1, which are wound onto the insertion plate 2, are omitted in FIG. 2.

Figure 3A:
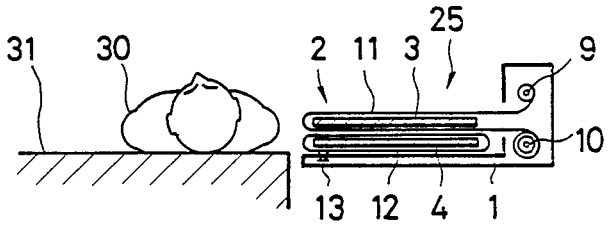
FIGS. 3(A)–(D) are explanatory views illustrating how the patient is loaded by the loading-unloading device.

A patient-moving device 25 equipped with the aforesaid loading-unloading device is used in the following manner. First, the patient-moving device 25 in which the horizontal base plate 1 is resting on and fastened to a movable truck 44 (shown in FIG. 5) is brought close to the side of a bed 31 on which a patient 30 is lying and is set in place there, as is shown in FIG. 3(A).

At this time, almost all of the excess of the upper belt 11 is wound onto the lower roller 10, and the upper roller 9 is locked so that it will not rotate.

Figure 3B:
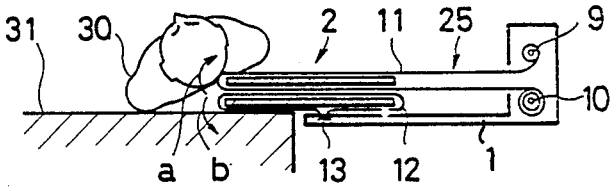

While maintaining this state, the insertion plate 2, which consists of the upper and lower plates 3, 4, is advanced by the motor 24, and the insertion plate 2 is moved out and inserted between the bed 31 and the patient 30, as is shown in FIG. 3(B). At this time, the lower roller 10 is rotated by the motor 15 in the direction for sending out the upper belt 11. As the insertion plate 2 advances, the upper belt 11 is wound out as shown by arrow "a" in FIG. 3(B) at the end of the part of the upper belt 11 which is wound out—that is, at the ends of the upper plate 3 and the lower plate 4. As the insertion plate 2 is inserted, the upper belt 11 is sent out from the lower roller 10. At this time, the lower belt 12, which forms a closed loop fastened to the fastening part 13 near the front of the lower horizontal base plate 1, circulates simultaneously around the lower plate 4 with the advance of the lower plate, as is shown by arrow "b".

When the insertion plate 2 is inserted in this way between the patient 30 and the bed 31, there is no change in the relative positions of the upper belt 11 on the upper plate 3 and of the lower belt 12 below the lower plate 4 with respect to the patient 30 and the bed 31, and there will be no sliding between any of them. Consequently, the insertion plate 2 will go in smoothly between the bed 31 and the patient 30.

Figure 3C:
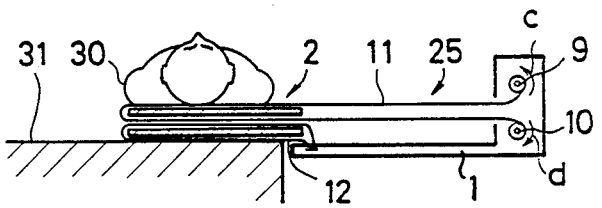

FIG. 3(C) illustrates the state after the insertion plate has been inserted under the patient 30 in this way. Almost all of the upper belt 11 has been withdrawn from the upper and lower rollers 9, 10, and the patient 30 is resting completely on the insertion plate 2.

Next, the upper roller 9 is unlocked, and both motors 14 and 15 are driven to rotate the rollers in the winding-up direction. The upper and lower rollers 9, 10 are rotated in the directions of arrows "c" and "d" in FIG. 3(C). Both ends of the upper belt 11 are wound up onto both rollers 9, 10 while at the same time the motor 24 is driven in reverse to retract the insertion plate 2.

Figure 3D:
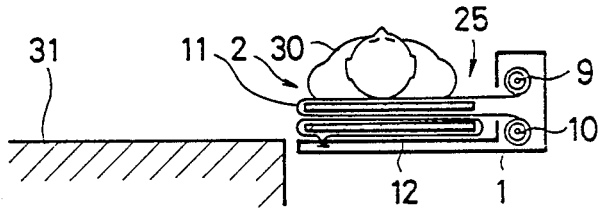

In this way, the patient 30 is moved onto the horizontal base plate 1 of the patient-moving device 25, as is shown in FIG. 3(D). In this state, the upper belt 11 (which was sent out from the lower roller when the insertion plate was inserted under the patient 30) is wound up, half of it on the upper roller 9 and half of it on the lower roller 10.

To return the patient 30 from the patient-moving device 25 onto the bed 31, it is sufficient to perform exactly the opposite operations of those described above.

The configurations of the upper and lower belts 11 and 12 and the rollers 9 and 10 provided on the insertion plate 2 are not limited to these. For example, the roller 9 and 10 are for the purpose of winding up or sending out both ends of the belt, and it is not necessary for them to be positioned one above the other. Therefore, rollers 9 and 10 may be positioned horizontally towards each other. Likewise, belts 11 and 12 may also take different configurations.

Furthermore, the driving mechanism of the insertion plate 2 also, in addition to that using an endless belt and pulleys shown in this embodiment, can also assume other configurations, such as one using nuts fastened to the insertion plate and ball screws penetrating through the nuts and connected on one end to a base plate 1.

Figure 4A:
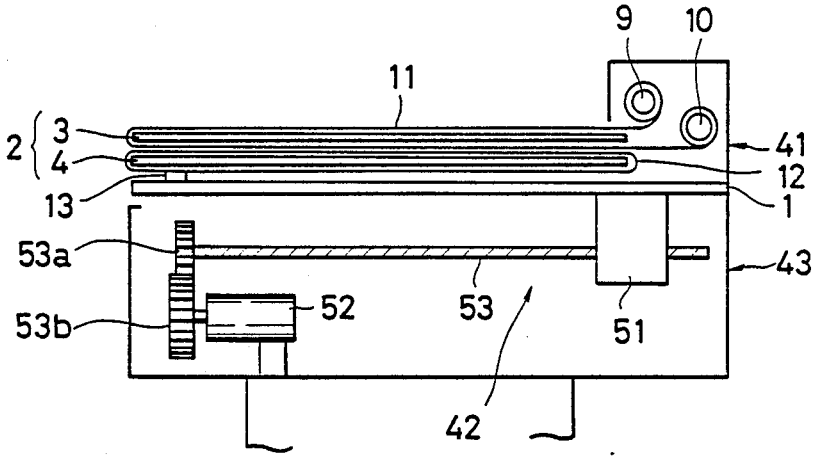
FIG. 4(A) is a schematic explanatory view illustrating an embodiment of the driving device of the patient loading-unloading device of the patient-moving device according to this invention.

In a patient-moving device according to this invention, the driving means 42 for advancing and retracting the horizontal base plate 1 of a loading-unloading device 41 is loated at the top of a support means 43. FIG. 4(A) illustrates an example of such a driving means 42. It has a nut 51 mounted on the bottom of the base plate 1 and a screw 53 which meshes with the nut 51. The screw 53 is supported by the support means 43 so that both ends of it can be rotated freely by a support means not shown in the drawing. It is driven through gears 53*a* and 53*b* by a motor 52 fastened on the top of the support means 43. Thus, the base plate 1 can move backwards and forwards along the screw 53.

Figure 4B:
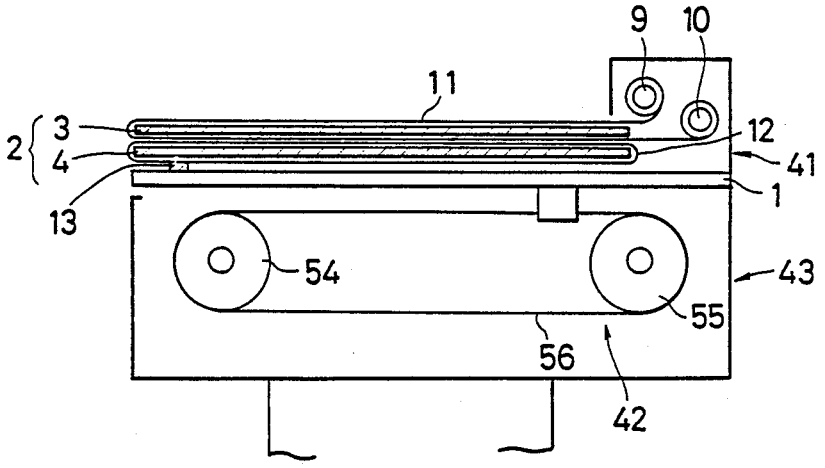
FIG. 4(B) is a schematic explanatory view illustrating another embodiment of the driving device of the patient loading-unloading device of the patient-moving device according to this invention.

Moreover, this can also be realized by fastening a pair of fixed pulleys 54, 55 on the side of the support means 43, as is shown in FIG. 4(B). A timing belt 56 is wound onto the pulleys 54, 55. A part of the timing belt 56 is fastened to the base plate 1, and one of the pulleys, either 54 or 55, is driven by a motor (not shown in the drawing) which is fastened to the support means 43.

Moreover, although this is not shown in the drawings, it is desirable to provide a guiding means for the horizontal base plate 1 on the upper surface of the support means 43 so that the horizontal base plate 1 will move only in the advancing and retracting direction with reference to the patient 30. It is also desirable for the driving means 42 of the base plate 1 to be configured so that it will lock when the base plate 1 is driven out so that the horizontal base plate 1 will not move while the patient 30 is being loaded or unloaded.

Let us describe, referring to FIG. 5, the operations of a patient-moving device according to this invention configured as described above.

FIGS. 5(A) through (E) are views illustrating the operations of a patient-moving device following this invention.

Figure 5A:
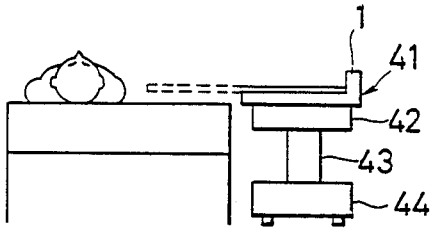
FIGS. 5(A)–(E) are explanatory views illustrating how a patient is moved by the patient-moving device of this invention.

As is shown in FIG. 5(A), according to this invention, the loading-unloading device 41 is mounted, through a means for driving the horizontal base plate 1 in and out, on a support means 43 which also serves as an elevator means. These devices are also mounted on a truck 44 which serves as a means for transport.

First, the patient-moving device is moved to the bedside of the patient who is to be moved, as is shown in FIG. 5(A).

Figure 5B:
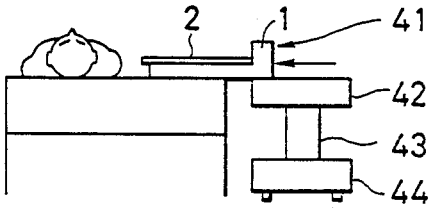
Figure 5C:
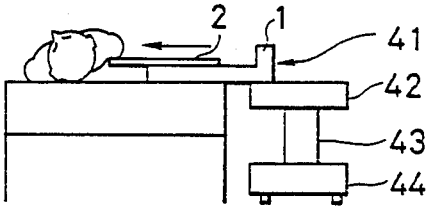

Next, the loading-unloading device 41 is advanced to a position adjacent to the patient, as is shown in FIG. 5(B).

The horizontal base plate 1 of the loading-unloading device is fastened in place at this position, and the insertion plate 2 is operated so as to load the patient onto the loading-unloading device, as is shown in FIGS. 3(A-)-(D).

Figure 5D:
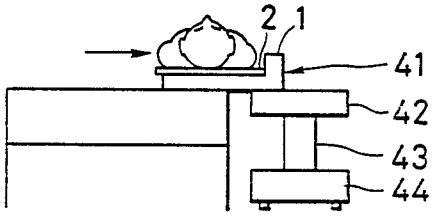

Once the patient has been loaded onto the loading-unloading device 41, the driving means 42 is operated in reverse so as to retract the loading-unloading device 41 with the patient lying on it—i.e, its horizontal base plate 1 and insertion plate 2, over the support means 43, as is shown in FIG. 5(D).

Figure 5E:
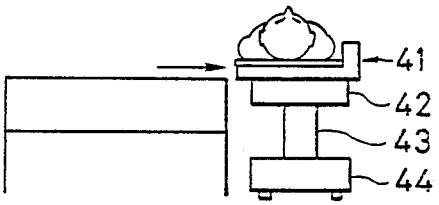

Thus, the patient is moved onto and rests stably on the loading-unloading device 41 in its retracted position overlapping the support means 43, as is shown in FIG. 5(E).

To move the patient from the loading-unloading device onto the bed, the aforesaid operations are performed in the reverse order. At this time, the position at which the patient is to be put can optionally be determined by varying the amount of the patient loading-unloading device being advanced.

When the insertion plate 2 is inserted between the patient and the bed in a loading-unloading device 41 of this type, in order to avoid giving the patient an unpleasant feeling, it is desirable to avoid moving the insertion plate with speeds fluctuating unstably. In this case, the upper belt 11 is wound out from the lower roller 10 as the insertion plate 2 advances. Therefore, if the speed of the insertion plate 2 is $V_{bd}(t)$ and the speed with which the upper belt 11 is wound out is $V_{bl}(t)$, the speeds should be controlled so that $$V_{bl}(t)=2\,V_{bd}(t) \quad (1)$$

If this is done, it will be possible, theoretically, to insert the insertion plate smoothly without any slipping of the contacting position between the patient and the upper belt 11 located on the upper surface of the upper plate 3.

The control method adopted in the past was one in which the driving motors for the rollers 9, 10 and the driving motor (omitted in the drawings) for advancing and retracting the insertion plate 2 were each rotated at constant speeds independently of each other. For example, controls in which integral compensating operations are added to proportional controls, that is PI controls, were often used. If PI controls are used, the motor driving current i is given by the following equation (2):

$$i=k_p(\omega_0-\omega)+k_i\int(\omega_0-\omega)dt \quad (2)$$

Here, $k_p$, $k_i$: Proportional gains $AF_0$: Target angular velocity of motor rotation AF: Current value of angular velocity In the final analysis, the rotation of the rollers 9 and 10 is controlled so that equation (1) will be satisfied in the state shown in FIG. 3(B), and $V_{bl}(t)=V_{bd}(t)$ will be satisfied in the state shown in FIG. 3(C).

However, there are the problems described below if the aforesaid controls are used. That is, when the insertion plate 2 is inserted between the bed 31 and the patient 30, the patient's weight operates as a disturbance on the servo system of the driving motor for moving the insertion plate 2 in and out. That is, when the insertion plate 2 is inserted between the bed 31 and the patient 30, large friction is produced between the upper plate 3 and the upper belt 11 by the patient's weight, and this frictional force acts as a disturbance counteracting the rotating force of the driving motor, and there is a drop in the advancing speed of the insertion plate 2, which had been driven at a constant speed until then. Of course, it is true that since PI controls are being carried out, large differences between the current speed and the target speed will cause the output of the integral term to increase gradually until a sufficient output to counteract the disturbance is obtained. Even if there is a frictional force caused by the patient's 30 weight, it will return to the original speed after a definite time. However, the patient will feel extremely anxious if the insertion speed fluctuates in this manner.

On the other hand, the frictional force caused by the patient's weight will not act as a disturbance on the roller driving motor 15 which drives the lower roller 10 for moving out the upper belt 11. Therefore, the upper belt 11 will come out with an unchanged speed even after insertion has begun. Consequently, for a specific time after the beginning of insertion, the relationship in the aforesaid equation (1) will collapse, the lower roller 10 will put out an excessive amount of the upper belt 11, and there will be slack in the upper belt 11 between the lower roller and the front end of the upper plate.

Moreover, with the patient loading-unloading device, the position of the patient can be adjusted after the insertion plate 2 has been inserted between the patient 30 and the bed 31 and the patient 30 has been put on the insertion plate 2. For example, the position of the patient 30 can be shifted back on the insertion plate 2 after the insertion plate 2 has been stopped by moving the upper belt 11 out from the lower roller 10 and winding the upper belt 11 in onto the upper roller 9. At this time, slack in the upper belt 11 will also occur. This is because the patient's weight is applied onto the roller driving motor 14 when the upper belt 11 is wound up on the upper roller 9 in order to pull the patient along, so that the motor's rotation speed drops. On the other hand, the patient's weight does not affect the roller driving motor 15 which turns the lower roller 10 for moving out the upper belt 11, and the latter motor's rotation speed remains constant.

In any case, when the upper belt 11 slackens, it interferes with the operations which follow. For example, even if the upper belt 11 is wound up on the lower roller 10, there will be the inconvenience that the tensile force will not be transmitted until the slack disappears. Moreover, since the amount of the upper belt 11 which is wound up will be inconsistent on the upper and lower rollers, whenever loading or unloading is performed it will be necessary to return them to the original correct status.

In addition, as is shown in FIG. 3(C), when the insertion plate 2 carrying the patient 30 is retracted and brought back over the horizontal base plate 1, the patient's weight will operate as a disturbance on the servo system of the driving motor for moving the insertion plate 2 in and out, but it will have little effect as a disturbance on the roller driving motors 14, 15 which wind up the upper belt 11 on the upper and lower rollers 9, 10. Therefore, for a definite period of time after the start of retraction, the rotation speed of the driving motor for moving the insertion plate in and out will drop, and the retraction speed of the insertion plate 2 will become slower, while at the same time the upper and lower rollers 9, 10 will attempt to wind up the upper belt 11 at a constant speed. For this reason, the insertion plate 2 is forced back inwards in the retracting direction by the upper belt 11. If the insertion plate 2 is forced back in this way, an excessive load is applied onto the transmission mechanism of the driving motor for moving the insertion plate in and out, its gear mechanisms begin to rotate more slowly or stop rotating. This causes anxiety in the patient and also leads to failures of the transmission mechanism.

Figure 6:
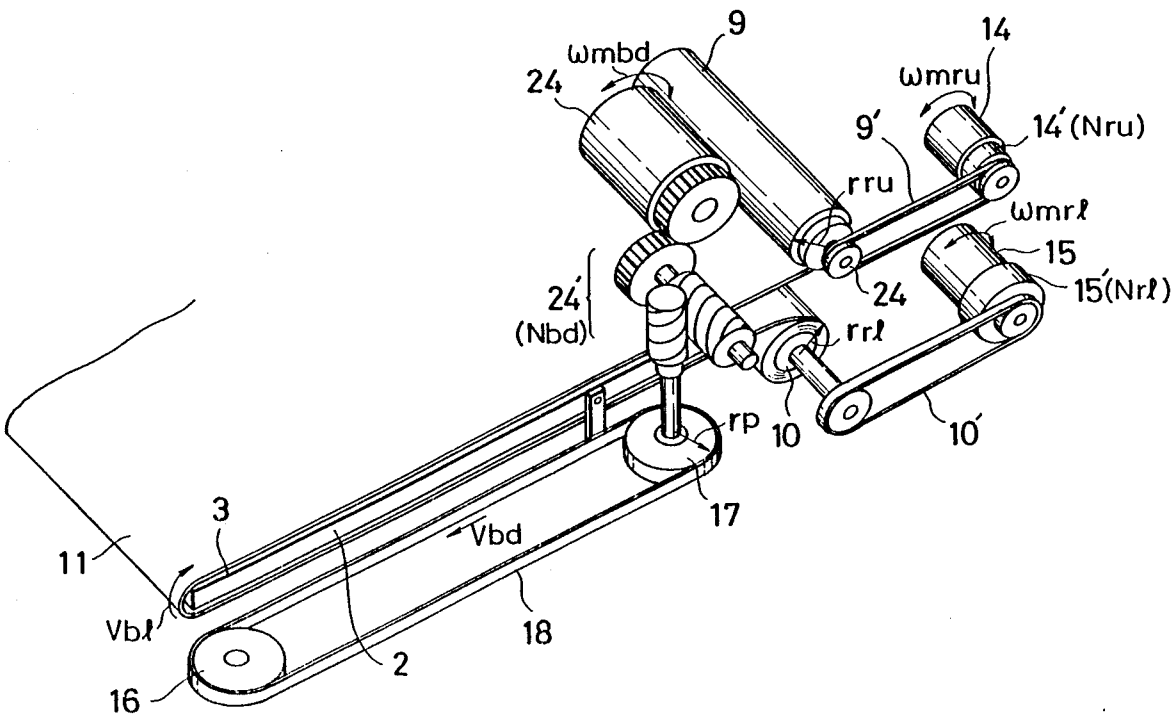
FIG. 6 is a perspective view showing the driving control system of the loading-unloading device.
Figure 7:
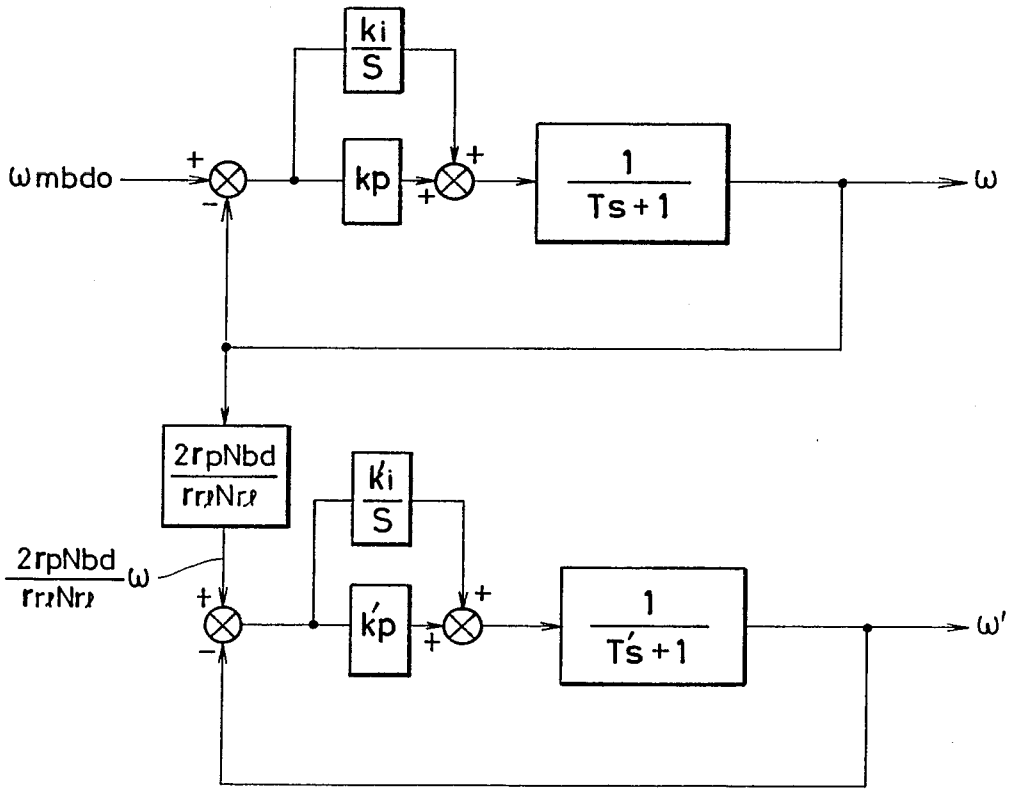
FIG. 7 is a block diagram of the control system in FIG. 6.

FIGS. 6 and 7 show the speed-control device of a loading-unloading device in which, in view of the foregoing, the amount of the upper belt 11 which is wound out and which is wound up is arranged appropriately so as to eliminate slackness of the upper belt 11 and to prevent the occurrence of failures during retraction.

That is, as is shown in FIG. 6, the endless belt 18 is wound between the pulleys 16 and 17, and the endless belt 18 and the upper plate 3 of the insertion plate 2 are connected by a coupling member. The rotational force of the driving motor 24 for moving the insertion plate 2 in and out is also transmitted to the pulley 17 through a train of reduction gears 24'. For this reason, the insertion plate 2 (specifically, the upper plate 3) advances or retracts when the driving motor 24 is driven forward or in reverse. On the other hand, both ends of the upper belt 11 wound onto the upper plate 3 are fastened to and wound onto the upper and lower rollers 9, 10. The rotational force of the driving motor 14 for the upper roller 9 is transmitted through a reduction gear 14' and a belt transmission mechanism 9' to the upper roller 9. The rotational force of the driving motor 15 for the lower roller 10 is transmitted through a reduction gear 15' and a belt transmission mechanism 10' to the lower roller 10. In this case, the pulleys 16, 17 for moving the insertion plate in and out have a radius $r_p$; the train of reduction gears 24' have a reduction ratio $N_{bd}$; the reduction gears 14' and 15' have a reduction ratio $N_{ru}$ and $N_{rl}$, respectively; and the rollers 9 and 10 have a radius of $r_{ru}$ and $r_{rl}$, respectively; Some parts of the insertion plate 2, such as the lower plate 4 and the horizontal base plate 1, are omitted from the drawing.

Next, the various operations and how they are controlled will be explained by referring to FIG. 6 and FIG. 7.

In order to insert the insertion plate 2 between the patient 30 and the bed 31, the upper plate 3 (and the lower plate 4, which is not shown in the drawing) is advanced by the driving motor 24, and the upper belt 11 is wound out from the lower roller 10 by the motor 15. The upper roller 9 is left shut down. In this case, the following controls are carried out so that there will always be a relationship of $2V_{bd}=V_{bl}$ between the speed $V_{bd}$ of the insertion plate 2 and the speed $V_{bl}$ with which the upper belt 11 is wound out. That is, controls are given so as to operate the motor 24 for moving the insertion plate 2 in and out at a constant speed, the actual speed is detected in comparison with this target value, and the speed of the roller driving motor is varied so that this actual speed will agree with the target value.

The following is an explanation of the foregoing in greater detail. The following expressions apply if the angular velocity of the driving motor 24 is $\omega_{mbd}$ and the angular velocity of the motor 15 for driving the lower roller 10 is $\omega_{mrl}$:

$$V_{bd}=r_pN_{bd}\,\omega_{mbd} \tag{3}$$

$$V_{bl}=r_{rl}N_{rl}\omega_{mrl} \tag{4}$$

Since $2\,V_{bd}=V_{bl}$, there will be the following relationship between the angular velocities of motors 15 and 24:

$$\omega_{mr}=\frac{2r_{pb}N_{bd}}{r_{rl}N_{rl}}\,\omega_{mbd} \tag{5}$$

Thus, speed controls are given for the driving motor 24, setting the target speed of the motor 24 at $\omega_{mbdo}$. That is, the actual angular velocity $\omega(t)$ is found from the output of devices such as a rotary encoder and potentiometer (omitted in the drawings) mounted on the motor 24, and the current i given in the following equation (6) is input into the motor 24:

$$i=k_p(\omega_{mbdo}-\omega)+k_i\int_0^t(\omega_{mbdo}-\omega)dt \tag{6}$$

Here, $k_p$ and $k_i$ are the optimal proportional gains established in this system.

On the other hand, another control system is established, in which $$\frac{2r_{pb}N_{bd}}{r_{rl}N_{rl}}\,\omega$$

is the target value for the output of the aforesaid control system. This system is used as the control system for the motor 15 driving the lower roller 10. That is, the current i' in the following equation (7) is input into the motor 15:

$$i'=kp'\left(\frac{2r_pN_{bd}}{r_{rl}N_{rl}}\,\omega-\omega'\right)+k_i'\int_0^t\left(\frac{2r_pN_{bd}}{r_{rl}N_{rl}}\,\omega-\omega'\right)dt \tag{7}$$

Here, $k_p'$ and $k_i'$: Proportional gain $\omega'$: Measured angular velocity of the motor 15

Since this system is adopted, if the speed $v_{bd}$ of the insertion plate 2 should drop momentarily as a result of insertion, the speed $v_{bl}$ with which the upper belt 11 is wound out will become accordingly slower in order to prevent slackening of the upper belt 11. Incidentally, the aforesaid control system can be configured simply with an analog circuit using an operational amplifier or with a digital circuit using a microcomputer.

To adjust the patient's position on the insertion plate 2 after its insertion, with the insertion plate 2 shut down, the upper belt 11 is wound up on either roller 9 or 10, while the upper belt 11 is wound out from the other roller. For example, if it is wound up on the upper roller 9 by the roller driving motor 14 and wound out from the lower roller 10 by the roller driving motor 15, controls are performed to make sure that the speed with which it is wound up on the upper roller 9 will be equal to the speed with which it is wound out from the lower roller 10. In other words, PI controls are performed for the motor 14 for the upper roller 9, and the output $\omega$ of this control system is found. There will be the following relationship at this time between the motor speeds of the motors 14 and 15:

$$\omega_{mrl}=\frac{r_{ru}N_{ru}}{r_{rl}N_{rl}}\,\omega_{mru} \tag{8}$$

Here $\omega_{mru}$: Angular velocity of the motor 14

$\omega_{mrl}$: Angular velocity of the motor 15

Thus, PI controls using $$\frac{r_{ru}N_{ru}}{r_{rl}N_{rl}}\,\omega$$

as the target value are performed for the motor 15 for driving the lower roller 10. Since this system is adopted, even if the speed with which the upper belt 11 is wound up by the upper roller 9 should drop momentarily, the speed with which it is wound out by the lower roller 10 will become correspondingly slower, and the upper belt 11 will not slacken. When the relationship of winding up and winding out between rollers 9 and 10 is reversed, PI controls are performed similarly for the motor 15 on the side where the upper belt 11 is wound up, and controls are performed for the motor 14 on the side where the upper belt 11 is wound out in accordance with the actual speed of the upper belt 11.

When the insertion plate 2 carrying the patient 30 is retracted and brought back over the horizontal base plate 1, the insertion plate 2 is retracted by the driving motor 24, and the upper belt 11 is wound up on rollers 9 and 10 by roller driving motors 14 and 15. Controls are also performed to make sure that the retracting speed of the insertion plate 2 will be equal to the speed with which the upper belt 11 is wound up. That is, PI controls are performed for the driving motor 24 for moving the insertion plate 2 in and out, and the output $\omega$ of this control system is found. At this time there is the following relationship between the motor speeds of roller driving motors 14 and 15 and of the driving motor 24:

$$\omega_{mru} = \frac{r_p N_{bd}}{r_{ru} N_{ru}} \omega_{mbd} \tag{9}$$

$$\omega_{mrl} = \frac{r_p N_{bd}}{r_{rl} N_{rl}} \omega_{mbd} \tag{10}$$

Therefore, PI controls are performed for the motor 14 for the upper roller 9 in which the target value is:

$$\frac{r_p N_{bd}}{r_{ru} N_{ru}} \omega$$

and PI controls are performed for the motor 15 for the lower roller 10 in which the target value is:

$$\frac{r_p N_{bd}}{r_{rl} N_{rl}} \omega$$

Since this system is adopted, even if the retraction speed of the insertion plate 2 should drop momentarily, the speed with which the upper belt 11 is wound up will become accordingly slower, and the insertion plate 2 will not be pressed back in the retracting direction by the upper belt 11.

In this way, by controlling the motors 14, 15 driving the upper and lower rollers 9, 10 as well as the motor 24 moving the insertion plate 2 in and out, it is possible to carry out the operations smoothly without any slackening of the upper belt 11 when the insertion plate 2 is advanced or when adjusting the patient's position, and also without the insertion plate 2 being forced back when it is being retracted.

Figure 8:
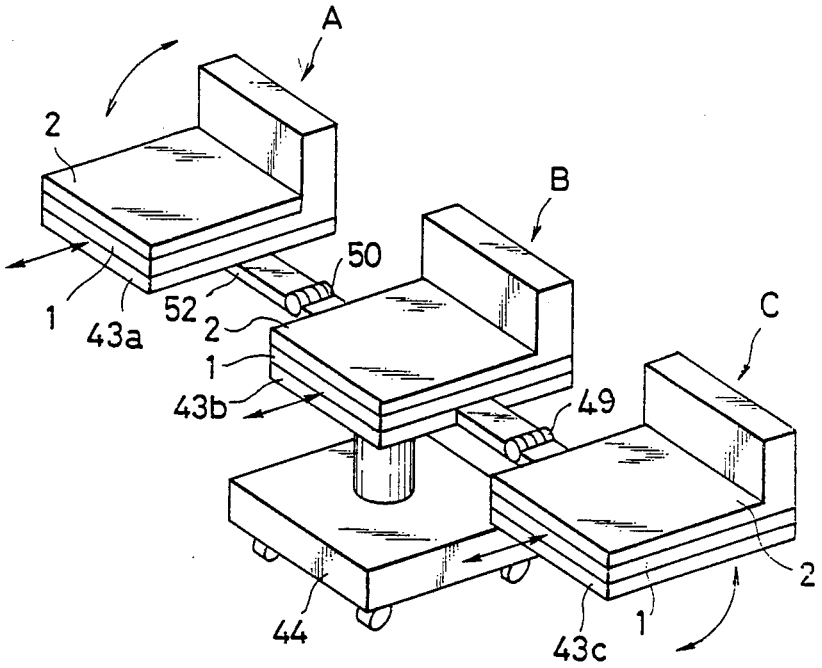
FIG. 8 is a schematic perspective view of another embodiment of this invention.

The insertion plate 2 and the horizontal base plate 1 in the patient loading-unloading device which have been described up to this point were configured to be slightly longer than a patient's height. However, the horizontal base plate 1 and the insertion plate 2 may also be divided, as in the embodiment shown in FIG. 8, into a first unit A which supports the upper half of the patient's body, a second unit B which supports the patient's torso and upper legs, and a third unit C which supports the patient's feet.

In units A, B and C, the horizontal base plate 1 is supported so that it can move in and out on the support means 43 with the built-in driving means 42, shown in FIGS. 4(A) and 4(B). The horizontal base plates 1 of each unit move in and out synchronously, and the insertion plates 2 on each horizontal base plate also move in and out synchronously. This makes it possible, no matter at what position on the bed 31 the patient 30 may be, to load the patient 30 from the bed 31 onto the three units, or, on the contrary, to unload the patient 30 from the three units onto the bed 31.

The support means **43*b* of the second unit B at the center rests horizontally on the truck 44. The support means 43*a* of the first unit A is coupled to the support means 43*b* of the second unit through a hinge 50 which can be fastened. The support means 43*c* of the third unit C is likewise coupled to the support means 43*b* of the second unit through a hinge 49** which can be fastened on the opposite side of the first unit A.

Therefore, the upper surfaces of the three units A, B and C are all put on approximately the same horizontal level, and the patient 30 is loaded onto them in the recumbent position. Then the hinges 49 and 50 are unfastened, and the hinge 50 of the first unit A is turned facing upwards and is fastened again. The third unit C is turned downwards, using its hinge 49 as the supporting point, and the hinge 49 is fastened again. In this way, the three units A, B and C can be transformed into the shape of an armless chair and the patient can be put into a seated position.

In addition, when not in use, the first unit A and third unit C can be folded up and laid on top of the second unit B so that the units can be stored in a compact form without taking up space. Furthermore, motors with small horsepower can be used to drive each of the horizontal base plates 1 and the insertion plates 2 of units A, B and C.

When a patient has been placed in this way on the three units A, B and C and units A, B and C have been brought from the horizontal position so as to form a chair, sliding sometimes occurs between the device and the patient, causing discomfort to the patient.

Figure 11:
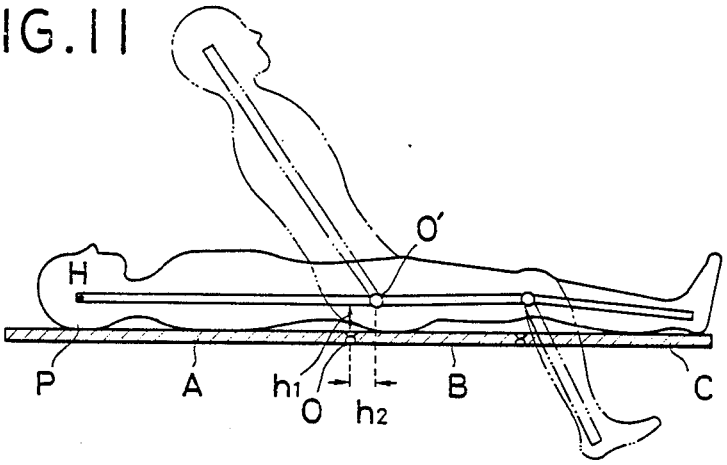
FIG. 11 is an explanatory view illustrating the patient's movement when the embodiment in FIG. 8 is transformed from the horizontal state into a chair and vice versa.

That is, as is shown in FIG. 11, the hinge O between units A and B, for example, is located below the upper surfaces of units A and B so that it will not interfere with the work of loading and unloading the patient. On the other hand, the axis 0', when the patient changes from the recumbent position to the seated position, is at approximately the center of the body thickness. That is, it is at a position at a distance above the aforesaid hinges O. Moreover, as is shown by the broken lines in FIG. 11, considering the thickness of the patient's waist when the patient has assumed the seated position, the hinge O between units A and B is located farther towards the patient's head in the horizontal direction than the patient's axis 0'.

Figure 12:
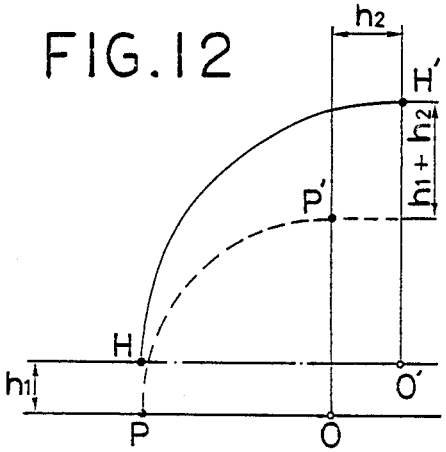
FIG. 12 is a model diagram illustrating the status in FIG. 11 geometrically.
Figure 13:
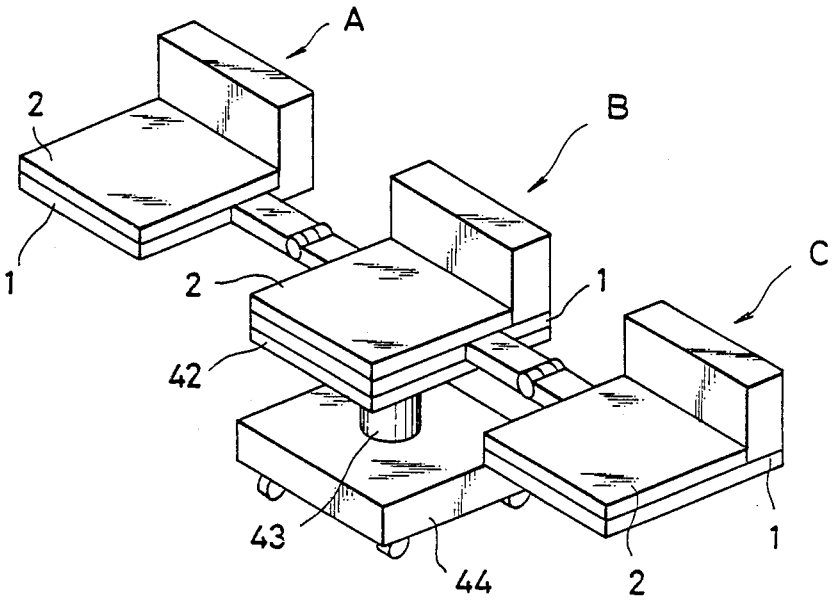
FIG. 13 is a schematic perspective view illustrating a modification of the embodiment in FIG. 8.

This is shown in simplified geometrical terms in FIG. 12, which also illustrates the movement of the patient's upper body. The chain line shows the patient's recumbent position, and the solid line shows the upper surface of the unit in the horizontal position. 0' shows the angle of rotation of the patient's hip joint in the recumbent position, and O shows the hinge between the first and second units A and B. H shows the center position of the patient's head in the recumbent position, and P shows the point of contact between the patient's head in the recumbent position and the upper surface of the first unit A.

As was described above, the distance between 0′ and O in the vertical direction amounts to $h_1$, a distance amounting to approximately half the thickness of the patient's body, and their distance in the horizontal direction amounts to $h_2$, a distance corresponding to approximately half the thickness of the patient's waist. Consequently, when the upper body of a recumbent patient is raised to the upright position, the patient's head will move to H′, and the point of contact between the patient's head and the device will move to P′. The shift in relative positions of H′ and P′ at this time will amount to $h_1+h_2$.

These changes in the relative positions of the device and the patient cause sliding between the patient and the device and, on account of the friction between the patient and the device, it will act as a compressive force on the patient in the body height direction at all points where loads are produced between the device and the patient. This sliding will also act as a tensile force on the patient when the shape of the device is changed back from that of a chair to the horizontal state.

Not only are the forces applied on the patient in this way unpleasant to the patient; if the patient has surgical injuries at the positions where these forces are applied, they may even be hazardous, given that the patient is disabled.

In order to avoid this, in the final analysis it will be necessary for the attendant to support the patient manually while raising up the first unit A for supporting the patient's upper body, and to hold the patient away from the upper surface of the first unit A while raising it. In this respect, a burden will still be placed on the attendant. In order to resolve this problem, the support means 43*a* of the first unit A for supporting the patient's upper body is mounted on a support 48 which can be moved along in the direction of the patient's body height. The support 48 is connected through the hinge 50 to the support means 43*b* of the center unit B.

Thus, between the support means 43*a* and the support 48 there is provided a driving means 47 for moving the unit A away from or towards the unit B. The driving means 47 moves along in the direction of the patient's body height. In this embodiment, this driving means 47 consists of a nut 56 fastened to the rear surface of a bottom plate 45 of the support means 43*a*, a ball screw 57 which penetrates through the nut 46, a motor 58, and a reduction gear 59 for rotating and driving the ball screw 57.

Figure 9:
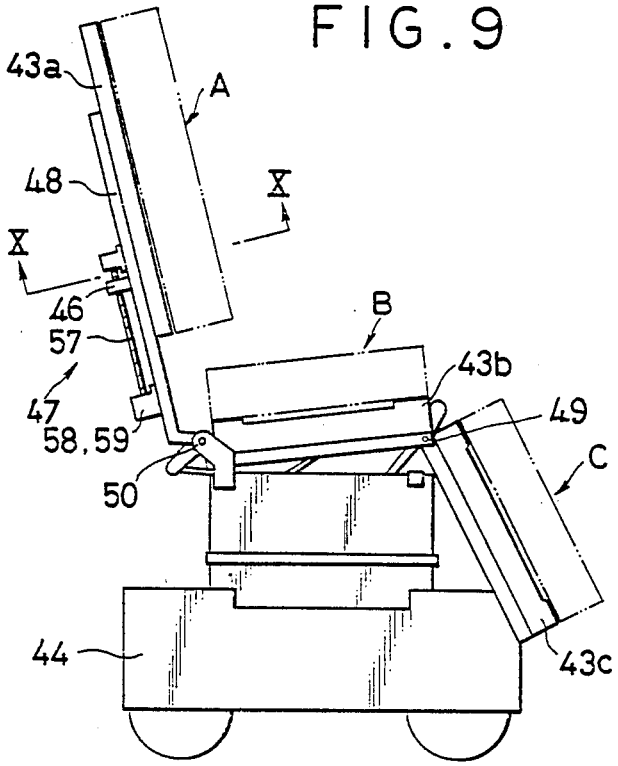
FIG. 9 is a side view showing how the embodiment of FIG. 8 is transformed into a chair.
Figure 10:
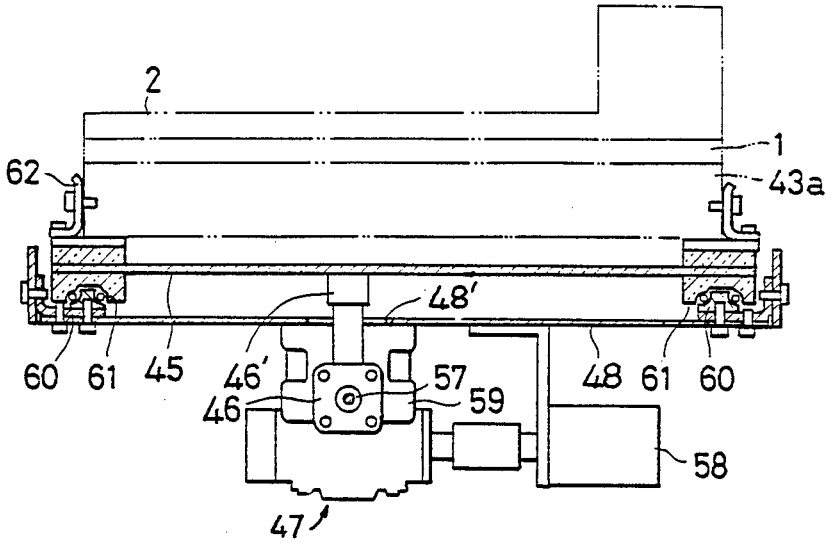
FIG. 10 is an enlarged sectional view at line X—X in FIG. 9.

As is shown in FIG. 10, which is the section indicated by line X—X in FIG. 9, two rails 60 are provided on the support 48 in parallel with the direction of the patient's body length. The bottom plate 45 of the support means 43*a* is rested through linear bearings 61 on the two rails 60, so that the bottom plate 45 can move smoothly in the direction of the patient's body length.

A frame 62 for fastening the support means 43*a* of the first unit A is provided on the bottom plate 45, and the support means 43*a* is fastened by screws or the like on the frame 62. The motor 58 and the reduction gear 59 are fastened on the support 48, and the ball screw 57 connected to the output shaft of the reduction gear 59 and the nut 46 penetrating through it are fastened to the bottom plate 45 through a bracket 46′. For this reason, there is provided in the support 48 a long hole 48′ in the direction of the patient's body height which passes through the bracket 46′.

Thus, when the patient has been placed on units A, B and C in the horizontal position and the first unit A is lifted up to change the shape into that of a chair, the ball screw 57 is turned by the motor 58. As a result, the first unit A, along with the support means 43*a*, is moved through the nut 46 and the bracket46′, synchronously with the patient's back, in the direction away from the second unit B. This makes it possible to eliminate most of the sliding which occurs between the patient and the first unit A.

When returning the first unit A to the horizontal position from a chair state, the motor 58 is rotated in reverse to move the first unit A synchronously in the direction where it will approach the second unit B. In this embodiment a moving mechanism was provided only on the first unit A, where the largest amount of the patient's weight is applied and where there is the largest relative displacement between the unit and the patient. However, the patient's comfort can be made even more perfect if such a mechanism is provided also on the third unit C. Furthermore, the provision of a moving mechanism on the second unit B is also, needless to say, included within the technical range of this invention.

A ball screw and nut were used in the driving means for moving the unit away from or towards the other unit in this embodiment, but it is also posible to adopt other mechanisms, such as hydraulic cylinders or rack-pinion mechanisms.

The configuration adopted in the above explanation is one in which support means 43*a*, 43*b* and 43*c* are each provided on separated units A, B and C and are coupled to each other through hinges 49 and 50. However, it is also possible to adopt another configuration in which units A, B and C are configured with support means 43 and driving means 42 present only on the truck 44 (that is, underneath unit B), and the parts above the horizontal base plate 1 are separated and are coupled to each other through the hinges 49 and 50. This configuration can be understood easily from the foregoing explanation if one bears in mind that, in this case, the base plate 1 part is divided into two parts: a part 1′ forming the base for the loading-unloading means, and a part 1″ changing the angle of the base plate.

As has been described in detail above, the patient-moving devices following this invention allow insertion plates to be moved out from horizontal base plates. In addition, the horizontal base plates can be moved out in the same direction as the insertion plates from support means. Moreover, when they are not moved out, the horizontal base plates and insertion plates are located overlapping each other on the support means. Therefore, the devices can be moved around freely within the narrow spaces between rows of beds, and regardless of what position on the bed the patient may be at, the insertion plate and the horizontal base plate can be moved out in a two-stage fashion, and the patient can be loaded onto the insertion plate without applying any burden on the attendant.

This makes it possible to resolve the problem of space. That is, it was necessary to increase the width of the insertion plate in the outward direction, and the insertion plate had to have a large outward stroke, in order to be able to load the patient on the insertion plate regardless of what position on the bed the patient may be at. It was sometimes impossible to bring the device into the spaces between beds when there were narrow spaces between the rows of beds.

In addition, the load applied on the driving means for moving the insertion plate in and out varies greatly when the patient's weight is applied on the insertion plate and when it is not. As a result, when a patient is loaded onto the insertion plate, the insertion plate may move in and out with unstably varying speeds or may stop, causing anxiety in the patient and applying excessive loads on the device which may lead to problems such as failures. However, in this invention, the aforesaid problem can be resolved by controlling the speed of the upper belt roller in accordance with the speed of the insertion plate when the insertion plate having a patient placed thereon is moved in and out.

The loading-unloading device can consist of a number of units which move apart from each other or approach each other in the direction of the patient's body height and which are connected to each other through hinges so that they can be inclined. Moreover, the device may be arranged so that the horizontal base plates and insertion plates of each unit move in and out synchronously as a single unit, and so that, when at least one unit is inclined from the horizontal position by hinges, it will move away from the adjacent unit. When this arrangement is adopted, it is possible to realize an even more ideal device whereby no mechanical loads are applied on the patient's body, not only during the patient loading-unloading operations, but also when changing the patient's position.

When a number of units are connected, the hinges between the units will be positioned under the units so that they will not interfere with the patient loading-unloading operations. It was necessary to widen the spaces between the units in order to avoid interference between the units, caused by the units' thicknesses, when one unit was turned in relation to another unit.

However, when a unit is turned, it moves away from the other unit in order to avoid interference between the units. When a unit which has been turned is returned to the horizontal position, it comes closer to the other unit, and the space between the units becomes narrower. This leads to the advantage that the patient can be loaded and unloaded more perfectly.

Obviously, many variations and modifications of the present invention can be made in light of the above teachings. It is therefore to be understood that, within the scope of the appended claims, the present invention may be practiced otherwise than as specifically described herein.

What is claimed is:

1. A patient-moving device comprising:

(a) a movable truck having a longitudinal axis and a lateral width;

(b) a horizontal base plate mounted on said movable truck for movement laterally thereof, said horizontal base plate having a lateral width at least approximately equal to the lateral width of said movable truck;

(c) first means for moving said horizontal base plate back and forth between a first position in which it is at least generally above said movable truck and a second position in which said horizontal base plate projects cantilever fashion to a first side of said movable truck;

(d) an insertion plate mounted on said horizontal base plate for movement laterally thereof, said insertion plate having a lateral width at least approximately equal to the lateral width of said movable truck and being sized and shaped to be inserted under a patient lying in bed; and (e) second means for moving said insertion plate back and forth between a first position in which it is at least generally above said horizontal base plate and a second position in which said insertion plate projects cantilever fashion to the first side of said horizontal base plate, said second means being mounted on and movable with said horizontal base plate, (f) the combined cantilever projections of said horizontal base plate and said insertion plate when in their second positions exceeding the lateral width of said movable truck.

2. A patient-moving device as recited in claim 1 wherein:

(a) said insertion plate comprises:

(i) an upper plate and (ii) a lower plate and (b) said patient-moving device further comprises:

(i) an upper roller disposed on the inboard side of said upper plate and mounted for rotation perpendicular to the direction of motion of said insertion plate;

(ii) a lower roller disposed on the inboard side of said upper plate and mounted for rotation perpendicular to the direction of motion of said insertion plate;

(iii) an upper belt having a first end attached to said upper roller, being passed around the outboard side of said upper plate, and having a second end attached to said lower roller;

(iv) a lower belt forming a closed loop around said lower plate, said lower belt being attached to said horizontal base plate;

(v) third means for rotating said upper roller when said insertion plate is being moved from its first position to its second position at a speed such that said upper belt remains taut over said upper plate;

(vi) fourth means for rotating said lower roller when said insertion plate is being moved from its second position to its first position at a speed such that said upper belt remains taut over said upper plate; and (vii) fifth means for spacing said upper plate and said lower plate apart while causing said upper plate and said lower plate to move together laterally.

3. A patient-moving device as recited in claim 1 wherein said second means comprises:

(a) a plurality of pulleys mounted on said horizontal base plate for rotation about axes perpendicular to the direction of motion of said insertion plate;

(b) an endless belt trained over said plurality of pulleys;

(c) sixth means for fastening said endless belt to said insertion plate; and (d) a first reversible motor for rotating at least one of said plurality of pulleys in either direction.

4. A patient-moving device as recited in claim 1 wherein said first means comprises:

(a) a nut attached to and movable with said horizontal base plate;

(b) a screw received in said nut and extending in the direction of motion of said horizontal base plate; and (c) a second reversible motor for rotating said screw in either direction, said second reversible motor being mounted on said movable truck.

5. A patient-moving device as recited in claim 1 wherein said first means comprise:

(a) a plurality of pulleys mounted on said movable truck for rotation about axes perpendicular to the direction of motion of said horizontal base plate;

(b) a timing belt trained over said plurality of pulleys;

(c) seventh means for fastening said timing belt to said horizontal base plate; and (d) a third reversible motor for rotating at least one of said plurality of pulleys in either direction.

6. A patient-moving device as recited in claim 1 wherein:

(a) said horizontal base plate and said insertion plate each comprise a plurality of paired segments spaced fom one another in the direction of the longitudinal axis of said movable truck and pivotable relative to one another about axes parallel to the direction of motion of said horizontal base plate and (b) said patient-moving device further comprises eighth means for moving at least one of said paired segments relative to at least one other one of said paired segments in a direction perpendicular to the motion of said horizontal base plate back and forth between a first position in which the two paired segments are relatively close together and a second position in which the two paired segments are relatively far apart.

7. A patient-moving device as recited in claim 6 wherein said horizontal base plate and said insertion plate each comprise three paired segments, a first paired segment sized, shaped, and positioned to support the patient's upper body, a second paired segment sized, shaped, and positioned to support the patient's waist and upper legs, and a third paired segment sized, shaped, and positioned to support the patient's feet.

* * * * *

UNITED STATES PATENT AND TRADEMARK OFFICE

CERTIFICATE OF CORRECTION

PATENT NO. : 4,794,655

DATED : January 3, 1989

INVENTOR(S) : Akihiro OOKA et al.

It is certified that error appears in the above-identified patent and that said Letters Patent is hereby corrected as shown below:

On the Title Page, Item [30]:

The third application number is incorrect; should read as follows:

-- Aug. 1, 1986 [JP] Japan ..... 61-179865 --

Signed and Sealed this

Sixth Day of June, 1989

*Attest:*

*Attesting Officer*

DONALD J. QUIGG

*Commissioner of Patents and Trademarks*